US008366018B1

(12) United States Patent
Giordano et al.

(10) Patent No.: US 8,366,018 B1
(45) Date of Patent: Feb. 5, 2013

(54) OIL INTENSIFIED COMMON RAIL INJECTORS

(75) Inventors: Daniel Donald Giordano, Colorado Springs, CO (US); Tibor Kiss, Manitou Springs, CO (US); James A. Peña, Encinitas, CA (US); John Mathew Quinlan, Fort Collins, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 745 days.

(21) Appl. No.: 12/485,728

(22) Filed: Jun. 16, 2009

Related U.S. Application Data

(60) Provisional application No. 61/073,196, filed on Jun. 17, 2008.

(51) Int. Cl.
*F02M 47/02* (2006.01)

(52) U.S. Cl. ..... 239/88; 239/533.2; 239/533.8; 239/533.9; 239/585.1; 239/585.3; 239/585.5; 239/89; 239/90; 239/91; 239/92

(58) Field of Classification Search ..... 239/88–92, 239/533.2, 533.8, 533.9, 585.1, 585.3, 585.5
See application file for complete search history.

(56) References Cited

U.S. PATENT DOCUMENTS 5,301,875 A 4/1994 Gant et al.
5,419,492 A 5/1995 Gant et al.
5,460,329 A * 10/1995 Sturman ..... 239/96
5,485,957 A 1/1996 Sturman
5,732,679 A * 3/1998 Takahasi et al. ..... 123/467
5,970,956 A 10/1999 Sturman
6,012,644 A 1/2000 Sturman et al.
6,085,991 A * 7/2000 Sturman ..... 239/88
6,161,770 A 12/2000 Sturman
6,257,499 B1 7/2001 Sturman
6,360,728 B1 3/2002 Sturman
6,684,853 B1 * 2/2004 Lei ..... 123/446
7,032,574 B2 4/2006 Sturman
7,108,200 B2 * 9/2006 Sturman ..... 239/88
7,412,969 B2 8/2008 Pena et al.
7,568,632 B2 8/2009 Sturman
7,568,633 B2 8/2009 Sturman

* cited by examiner

*Primary Examiner* — Jason J Boeckmann
*Assistant Examiner* — Joel Zhou
(74) *Attorney, Agent, or Firm* — Blakely Sokoloff Taylor & Zafman LLP

(57) ABSTRACT

Oil intensified common rail injectors that combine a common-rail non-intensified injector with an oil-intensified injector. The invention also uses fuel (common rail) pumps that are commercially available since the injector does not rely on this pump for intensification function. Also, since the pressure of the fuel pump is limited to lower than the intensified pressure, the injected pressure is limited to the unit injector; this eases the rail and tube requirements to this lower fuel rail pressure. The injector operates up to this limited pressure with no intensification. Also a separate oil system is configured to operate a hydraulic intensifier. Thus the system is able to achieve very high injection pressure without common rail pump, rail, fitting and jumper tube limits. The oil system does not need to operate or run unless these elevated pressures are required. Embodiments using direct needle control are disclosed.

10 Claims, 10 Drawing Sheets

OIL INTENSIFIED COMMON RAIL INJECTORS

CROSS-REFERENCE TO RELATED APPLICATION

This application claims the benefit of U.S. Provisional Patent Application No. 61/073,196 filed Jun. 17, 2008.

BACKGROUND OF THE INVENTION

1. Field of the Invention

The present invention relates to the field of fuel injectors.

2. Prior Art

A previous method utilized an intensified injector that used medium pressure (1200 bar) fuel as the actuation fluid for the intensification section. However the quantity of fuel needed to properly perform the intensification process currently exceeds the capacity of commercially available fuel pumps. Also by using fuel for the intensification function, static leakage in this area was problematic/expensive.

Another previous method was the intensified injector in which low pressure oil (<300 bar) was used in a hydraulic intensifier to raise the fuel pressure to a high level for injection. In this injector, fuel pressure was kept near ambient.

DETAILED DESCRIPTION OF THE PREFERRED EMBODIMENTS

The purpose of this invention is to combine a common-rail non-intensified injector with an oil-intensified injector. The advantage of the oil-intensified injector is that oil pumps to provide this level of pressure (<320 bar) are commercially available in the flow rates required.

The invention also uses fuel (common rail) pumps that are commercially available since the injector does not rely on this pump for intensification function (small pump requirement). Also, since the pressure of the fuel pump is limited to lower than the intensified pressure, the injected pressure is limited to the unit injector; this eases the rail and tube requirements to this lower fuel rail pressure. The system is able to achieve very high injection pressure without common rail pump, rail, fitting and jumper tube limits.

A small, commercially available common rail pump is used to a limited 'medium' (approximately 1200 bar) pressure (it should be noted that this pressure is not limited to 1200 bar, but should be less than the targeted intensified pressure). This fuel source is connected to the injector. The injector operates up to this limited pressure with no intensification. The injector uses this limited pressure with a needle control valve also using this fuel/pressure source.

A separate oil system is configured to operate a hydraulic intensifier. Without using this system, the injector operates solely on fuel and only up to the limited fuel rail pressure. The oil-operated intensifier system acts as a separate unit pump used to boost the fuel pressure in the injector, when needed, to above the level of the medium pressure of the fuel pump/rail. The oil system does not need to operate or run unless these elevated pressures are required. This extends to engine starting, cold starting, idle, light load conditions, etc. This improves sociability and efficiency over old systems.

Also, since the needle control valve operates using the limited pressure fuel source, we are able to run very high (approximately 3000 bar) intensified pressures without burden to the needle control valve. This fact permits the injector to operate at higher pressures than most systems without being limited by the typical pressure limits of needle control valves.

Two embodiments are specifically disclosed, one wherein the intensifier, when used, is refilled with fuel from the medium pressure fuel source, whereas in a second embodiment, the intensifier, when used, is refilled with fuel from a low pressure fuel source.

Figure 1:
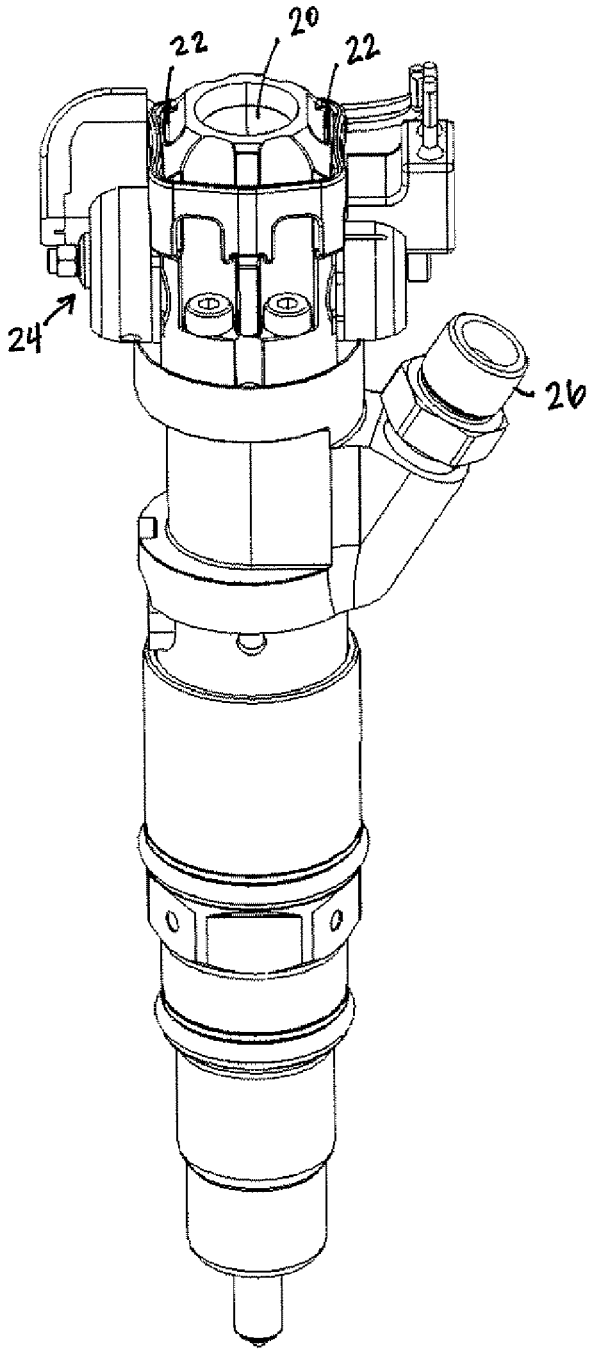
FIG. 1 is an overview of the entire injector of one embodiment of the present invention.
Figure 2:
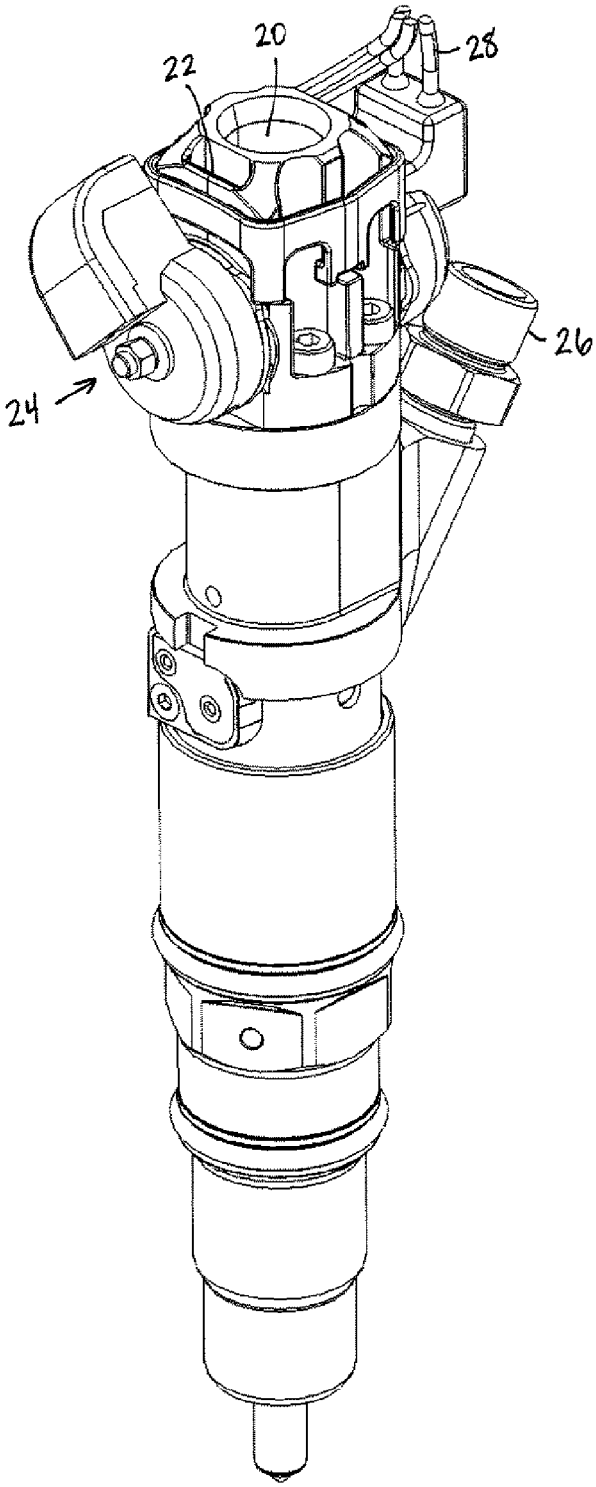
FIG. 2 is an isometric view showing the needle control valve wire egress location.

Now referring to FIG. 1, an overall view of one embodiment injector in accordance with the present invention may be seen. The injector includes a connection 20 to a supply of actuation fluid for the intensifier, and two low pressure vent slots 22 for venting the actuation fluid, all controlled by a three-way spool valve generally indicated by the numeral 24. Also visible in this Figure is a nut or connection 26 for connection to a medium pressure fuel supply adequate for up to medium pressure fuel injection without intensification. The foregoing various parts of the injector are also visible in the isometric view of FIG. 2, which also shows the spool valve and needle control valve external wires 28.

Figure 3:
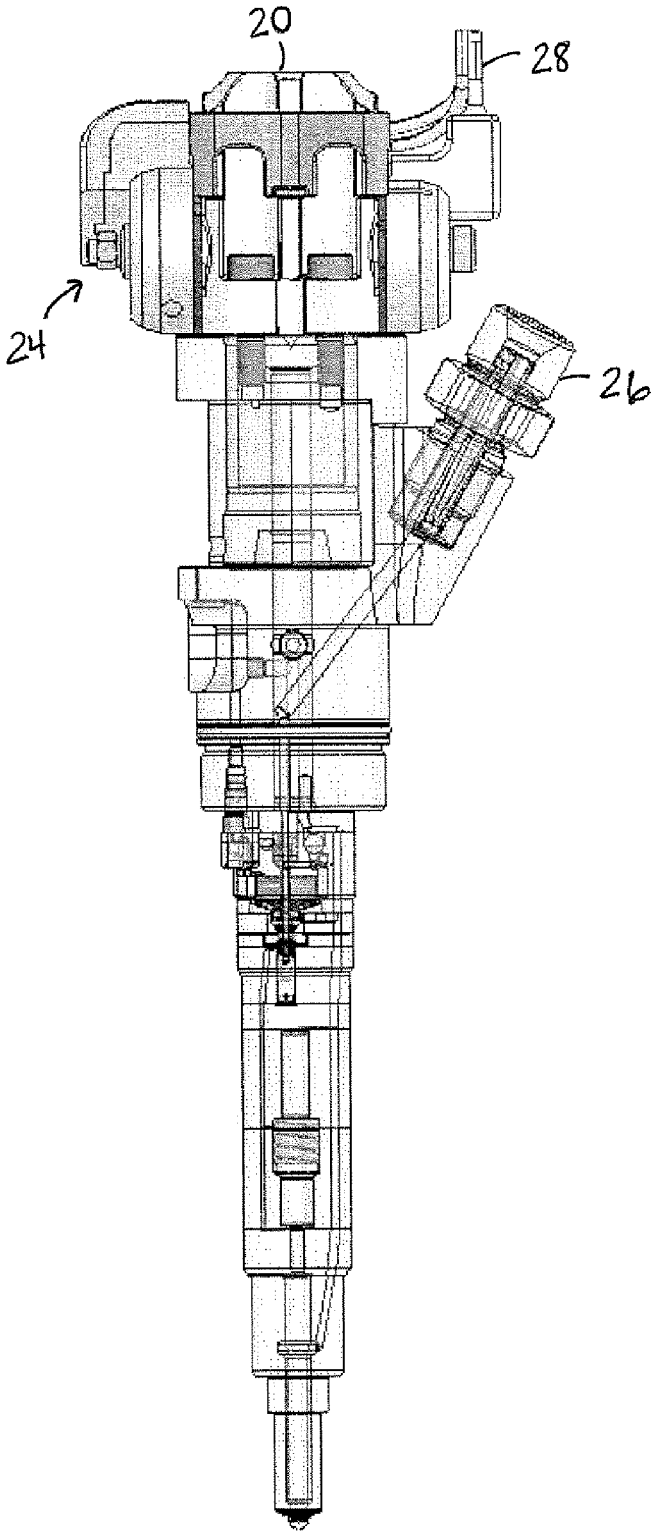
FIG. 3 is a transparent view of the injector of FIG. 1.
Figure 4:
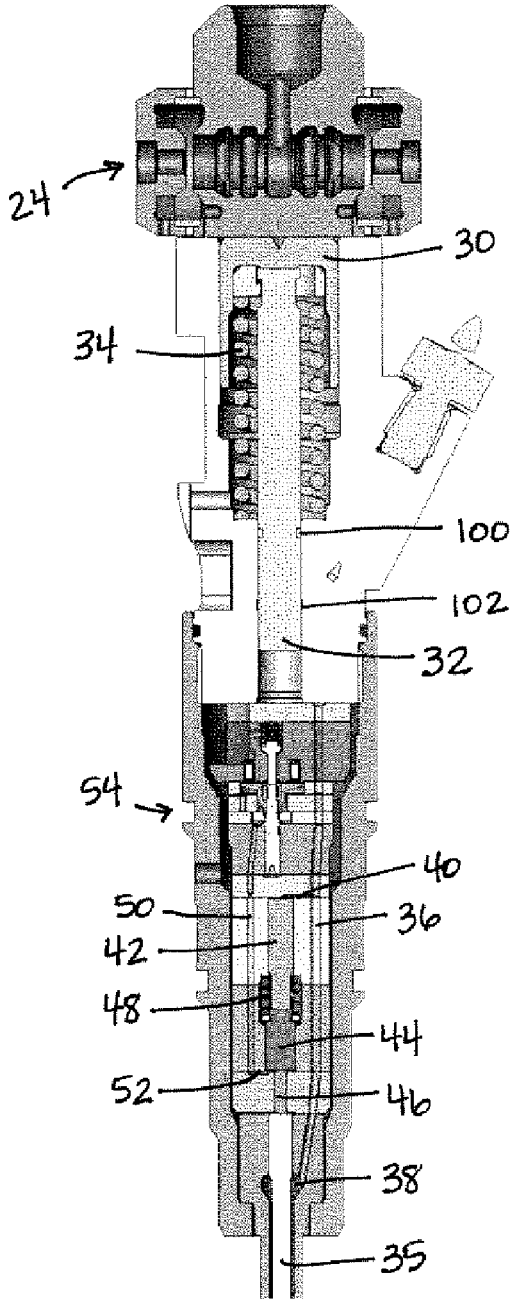
FIG. 4 shows a cross section of the injector.
Figure 5:
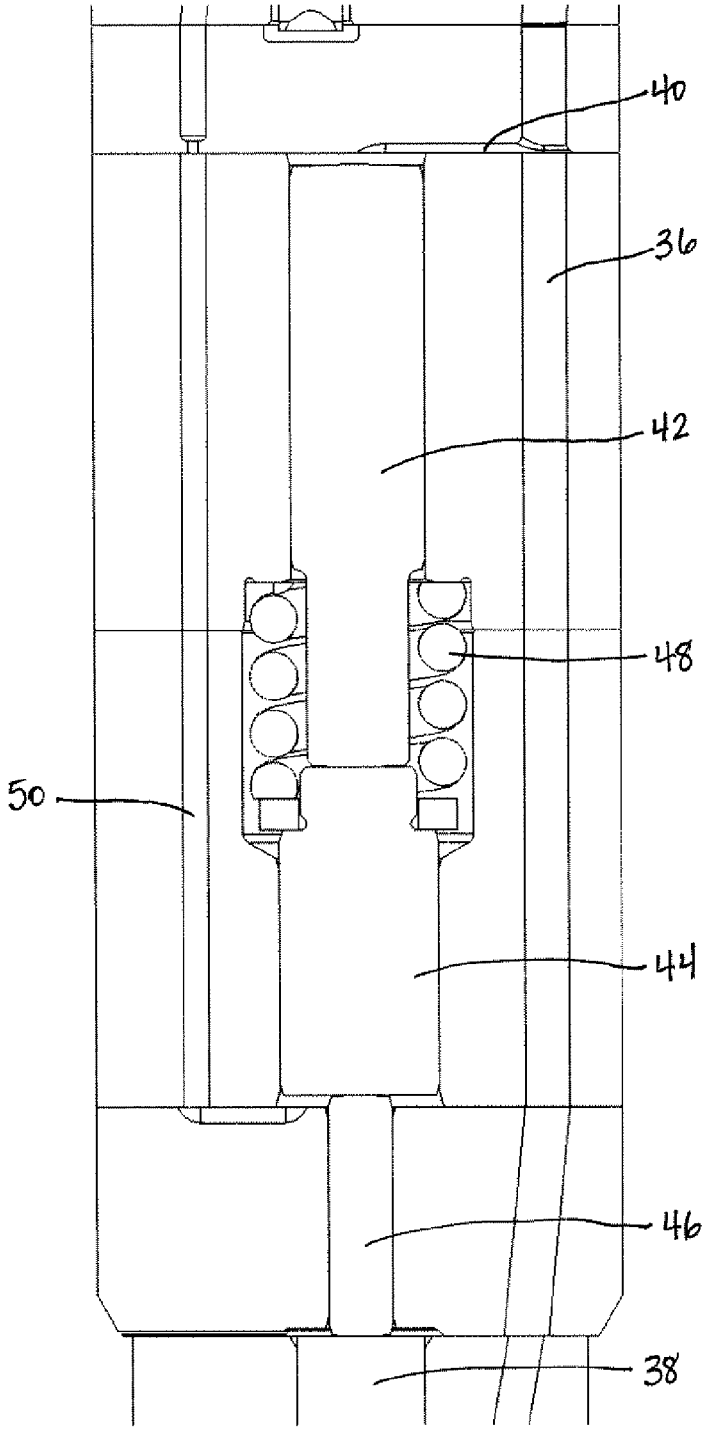
FIG. 5 is a view of the needle control module.

FIG. 3 is a transparent view of the injector of FIG. 1, and FIG. 4 is a partial cross section thereof. As may be seen in FIG. 4, an intensifier piston 30 controlled by spool valve 24 powers intensifier plunger 32, with coil spring 34 providing a return therefor. Also visible in FIG. 4 is the upper part of needle 35 and line 36 providing fuel, intensified or not, to needle chamber 38 surrounding needle 35. As may be seen in FIG. 5, fuel pressure in line 36 is also coupled through region 40 to the top of piston 42, which in turn pushes against the top of needle 35 through pins 44 and 46, with coil spring 48 holding the needle closed when there is no fuel pressure. Pin 44 is larger than piston 42 so that when fuel pressure is coupled through line 50 and 52 to the bottom of pin 44, that pressure will force pistons 42 and pin 44 upward, allowing the needle 35 to open for fuel injection. Note that as shall be subsequently more fully described, during intensification, the top of piston 42 is subjected to intensified fuel pressure, whereas for injection, non-intensified fuel pressure is applied to the bottom of pin 44, so area ratios must be selected for both when the fuel pressure is intensified and when it is not intensified.

Also as shall subsequently be seen, fuel pressure in line 50 is controlled by a double acting poppet valve, generally indicated by the numeral 54. That poppet valve may be seen on expanded scales in FIGS. 6 and 7. Poppet valve member 56 closes against a valve seat at the top of member 58 when in its lower position, and when in its upper position, closes against a seat on a floating seat member 60 held in position by a spring 62. The floating seat member 60 is free to slide sideways to a limited extent so as to be self-centering with the poppet valve. Fuel under pressure in line 50 is coupled to region 64 below the lower poppet valve. Note that in the two embodiments disclosed in detail herein, line 50 is coupled to the fuel supply pressure at port 26 (FIG. 1), whether or not the fuel pressure is intensified, and thus during intensification, is lower in pressure than the pressure in line 36, but is equal to the pressure in line 36 if intensification is not used.

The poppet valve member 56 is generally urged downward by coil spring 66 acting against member 68, but is free to move upward on coupling an actuation current through solenoid coil 70 which provides direct magnetic attraction on the armature 72 connected to the poppet valve member 56. Region 74 above the upper poppet valve is coupled to a low pressure fuel vent so that when the poppet valve member 56 is in the lower position, fuel in region 64 is blocked by the lower poppet valve, though line 50 is coupled through the upper poppet valve to vent region 74. In this condition, region under pin 44 (FIG. 4) is coupled to vent so that fuel pressure on the top of piston 42 will hold the needle closed. However when an actuating current is applied to the solenoid coil 70, poppet valve member 56 will move upward. The upper poppet valve will close to prevent fluid flow to the vented region 74 and the lower poppet valve will open, allowing fuel pressure in region 64 to be coupled to line 50 to allow the needle to open under fuel pressure in the needle chamber 38.

Figure 8:
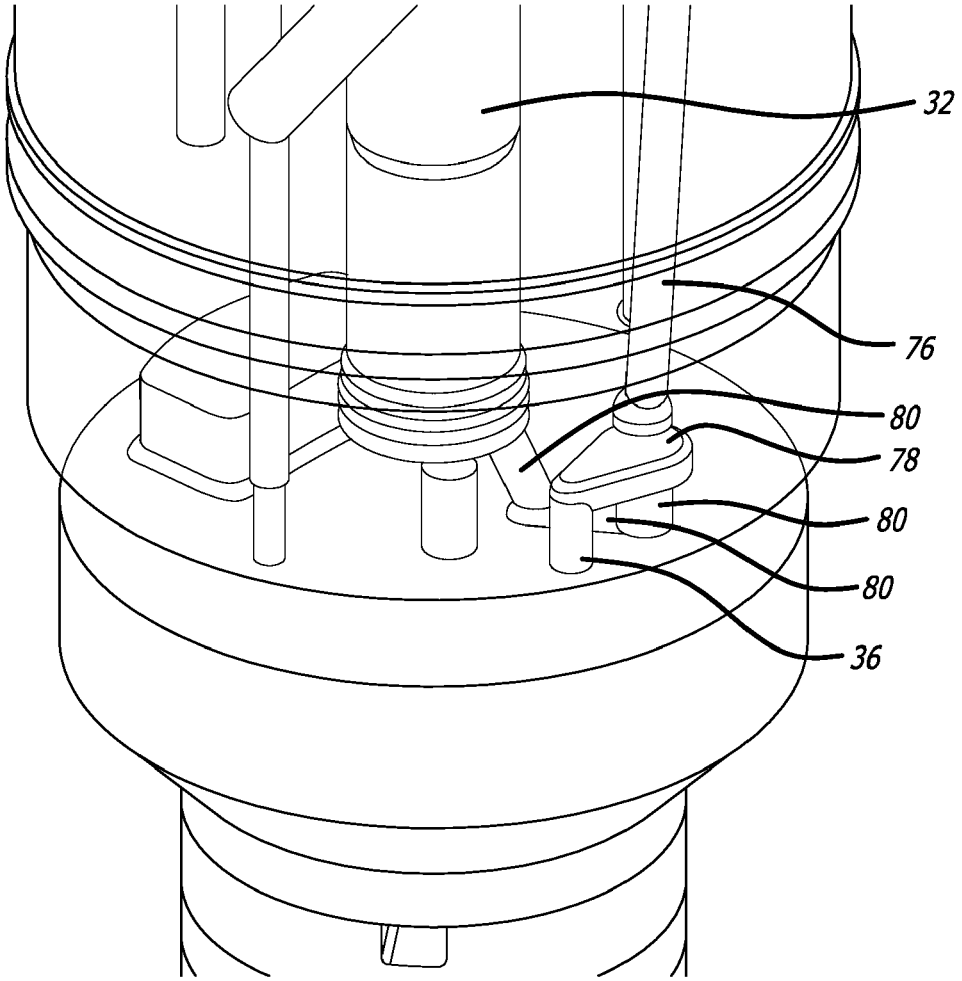
FIG. 8 is a view showing the check-fill arrangement of an alternate embodiment.

Now referring to FIG. 8, the source of fuel under pressure in line 36 (FIG. 4) may be seen. Fuel under pressure is provided through a connection to line 26 (FIG. 1) through line 76 and through a ball valve 78. When the intensifier is not being used and fuel is to be injected directly from the pressure in the fuel supply, ball valve 78 will open, allowing fuel to flow from supply line 76 to line 36, as well as to flow to the chamber under the intensifier plunger 32 through line 80. This, of course, refills the intensifier, ready for subsequent use. If on the other hand the intensifier is used, then when the intensifier plunger 32 moves downward, ball valve 78 will close, thus acting as a check valve to allow intensified fuel pressure in line 80 to be coupled to line 36. This will not cause fuel injection however, which will only occur on actuation of the direct needle control valve 54. Thus the injector operates with direct needle control directly from a medium pressure fuel source coupled to the injector, even when fuel for injection is intensified when higher injection pressures are needed. Between intensifications, when the chamber beneath the intensifier plunger 32 is to be refilled, spool valve 24 vents the area over the top of intensifier piston so that fuel under pressure of the fuel supply in line 76 will open ball valve 78 to refill the chamber under plunger 32.

Figure 9:
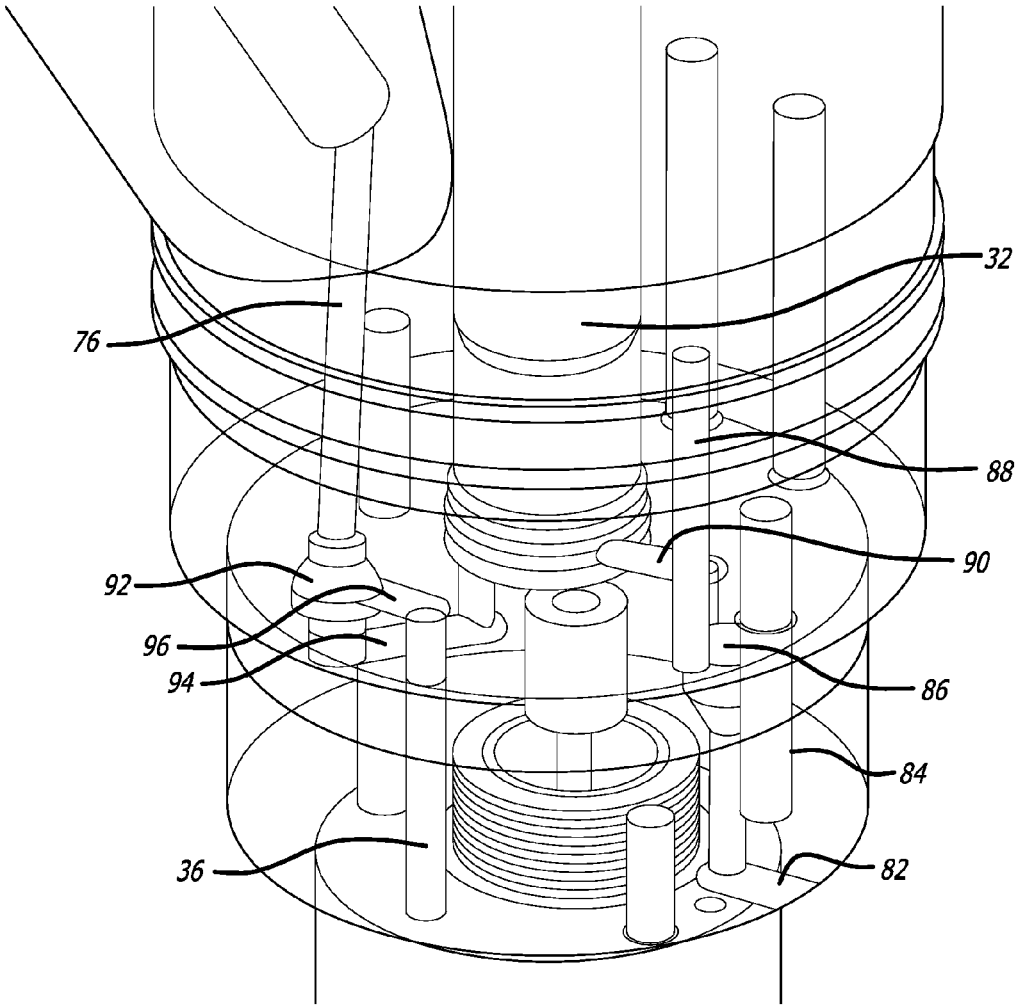
FIG. 9 is a view showing the check-fill arrangement of the embodiment of FIG. 1.

The refilling of the plunger chamber with fuel under an adequate pressure for injection without intensification is not the most efficient way of operating such an injector. Thus FIG. 9 illustrates details of an alternate embodiment wherein the chamber under intensifier plunger 32 is refilled with fuel, not from the medium pressure fuel source, but rather from a low pressure fuel source. In particular, the embodiment of FIG. 9 uses two ball valves forming three check valves, which operate as follows. For refilling the intensifier with fuel, low pressure fuel is introduced through channel 82 which is coupled through line 84 to ball check valve 86. To refill the plunger chamber, the check valve 86 will open to couple fuel through lines 88 and 90 to the intensifier chamber. However, when fuel intensification is occurring, check valve 86 will close, preventing fuel flow back out through low pressure line 82.

Figure 6:
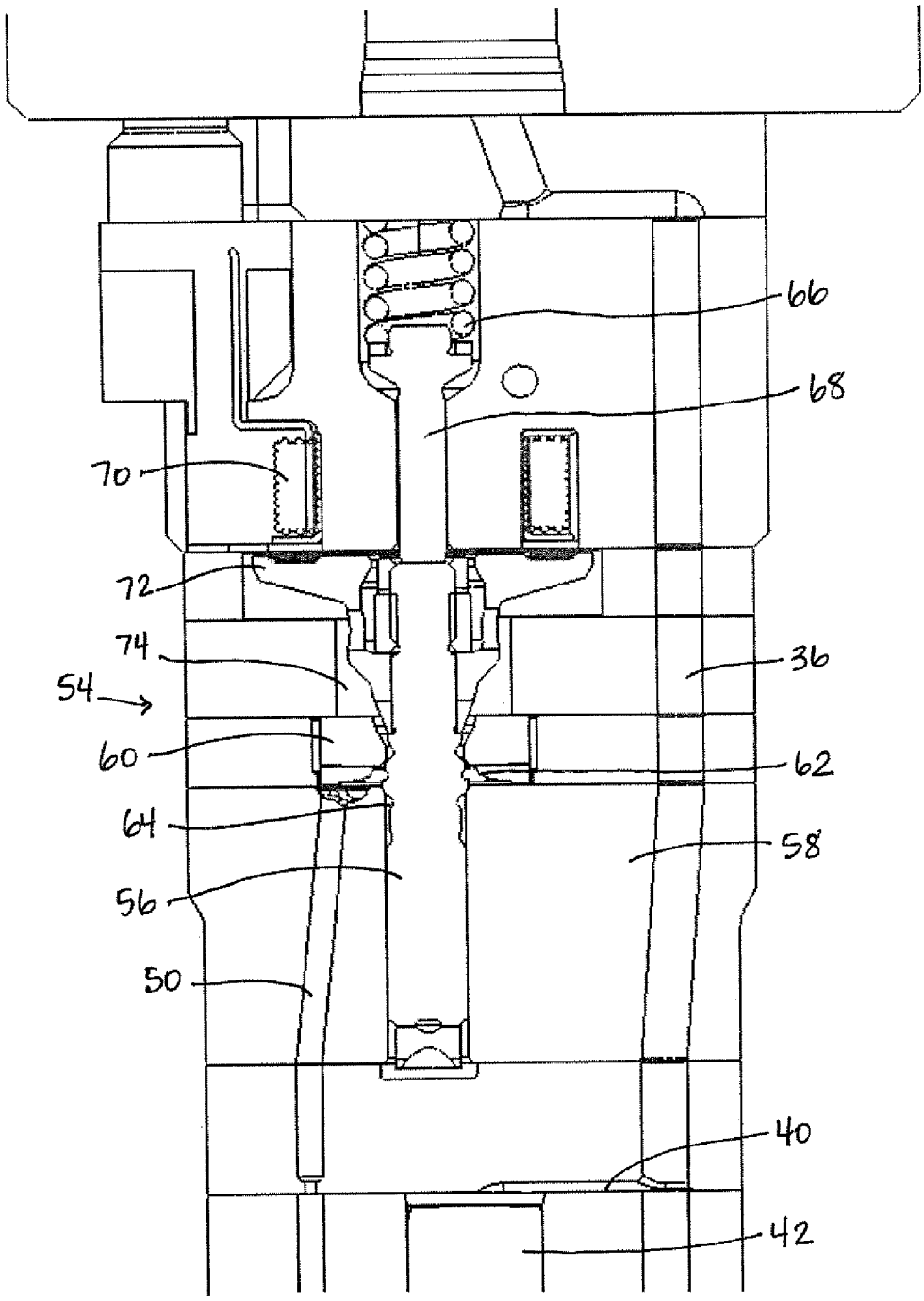
FIG. 6 is a view showing the needle control valve.
Figure 7:
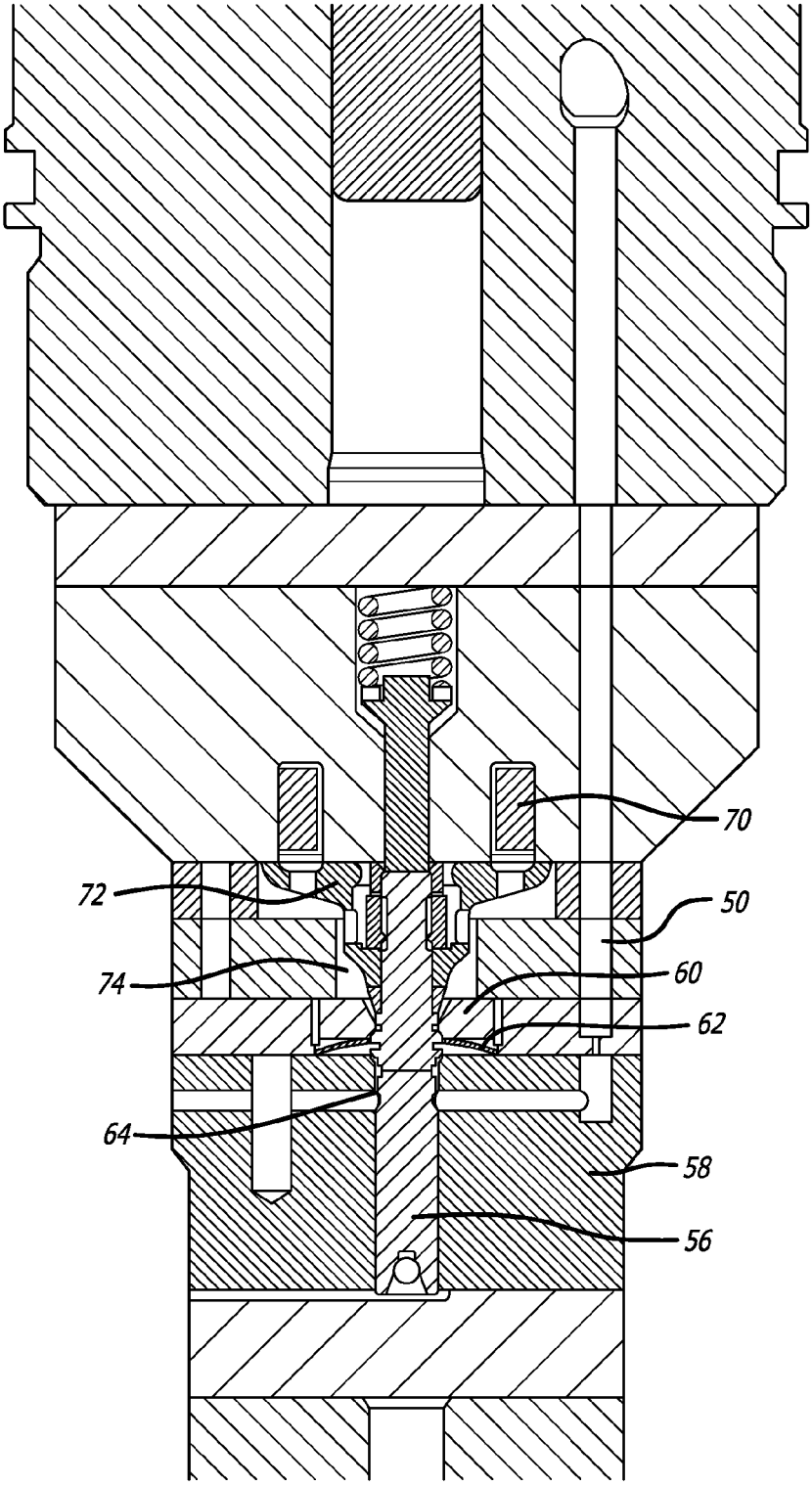
FIG. 7 is another view showing the needle control valve.

A second ball valve 92 acts as a double check valve as follows. Fuel under pressure is directly coupled to line 76 as in the first embodiment. If the intensifier is not being used, ball valve 92 will be in the lower position, blocking fuel flow through channel 94 to the intensifier chamber, but allowing fuel flow from line 76 to line 36 for direct fuel injection through control of the needle control valve 54 (FIG. 6). However when the intensifier is being used, intensified fuel pressure in channel 94 will force the ball valve 92 to the upper position, preventing flow back into line 76 but allowing flow through channel 96 to line 36. Thus in this embodiment, as before, fuel injection may be by way of injection directly from a fuel supply pressure using direct needle control, or alternatively, through intensified fuel pressure using an intensifier powered, not by fuel, but rather by a separate actuation fluid, typically engine oil, in both cases fuel injection occurring through direct needle control using a double acting poppet valve for controlling injection.

Figure 10:
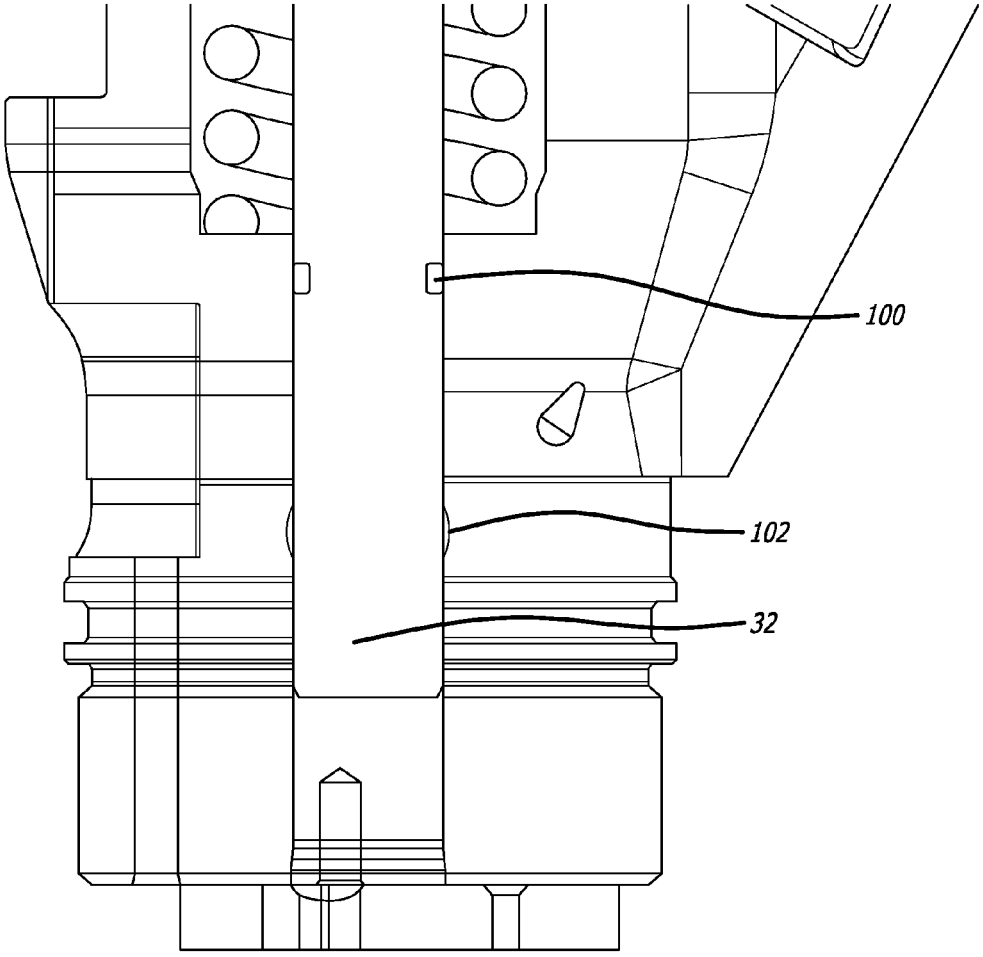
FIG. 10 is a view showing the only fuel/oil separation area.

In FIG. 4 (see also FIG. 10), an O-ring 100 is added to the plunger 36. This seal is only subject to low pressure fuel as this design retains the plunger bore vent drain 102. An unlikely failure of this seal will not cause any oil to get into the fuel, but rather a slight amount of fuel into the oil.

The use of the proven, low leak double acting poppet valve is important to small quantity control and high efficiency. Its single coil, poppet design is fail safe, robust and offers very high signal to noise ratio. It is a 3-way configuration, offering much better needle-valve open and close rate control with no short circuit loss during injection events, typical of two way valve, common rail approaches. The floating seat design offers excellent self alignment, reducing any tendency of stiction. The orifice controlled, short stroke valve has been shown to offer very precise small quantity control at all pressures. (It is noteworthy that a typical two way valve, in order to achieve high needle closing rates, must have very large orifices, which increases the fuel loss during an injection event. Furthermore, these large orifices reduce the injector's ability to control small quantities due to the large gain of the resulting valve. For this reason, a typical two way common rail control valve must compromise fuel efficiency, needle closing rate, minimum quantity control and pressure ratio. The use of a three way valve addresses all of these deficiencies.)

The embodiments disclosed herein use a "fuel-under" design for needle control, which is superior to common-rail-style "fuel-over" designs, as it results it much higher needle closing rates and has lower needle valve seat loading (critical for the very high pressure requirements of the application). This configuration, coupled with the three way control valve is ideally suited for the high pressure and multiple injection event requirements of this application.

Thus the advantages over what has been done before include the ability to run very high injection pressures without needing either of the following:

1. High flow medium pressure fuel pump
2. Very high pressure low flow fuel pump

Additional features include:

3. Lower static leakage compared to all fuel intensified systems
4. Better cold starting characteristics compared to oil intensified systems
5. Improved NVH over oil intensified systems An alternate to the embodiments disclosed could include the needle control valve connected to the intensified fuel circuit. In the case of non-intensified function, it would operate identically. During intensification, the needle control valve would operate with the very high pressure intensified fuel source. This configuration simplifies construction of the injector, but necessitates use of a needle control valve capable of full pressure fuel operation.

Thus the invention includes two separate fluid systems with the ability to operate the injector without having to operate the oil circuit:

1. Easier cold start by not having to operate the oil circuit during this function
2. Lower NVH by not having to operate the oil circuit during light loads
3. Improved efficiency by not having to operate the oil circuit (static leakage at intensifier circuit) during light loads
4. Very high injection pressures when needed because of the availability of the oil based hydraulic intensifier The invention provides:

A fuel system from running two discrete fluid circuits, when both circuits are significantly above ambient pressure. The ability to run these circuits independently from each other.

The ability to operate on a singe (fuel) circuit during certain conditions, matching common rail system type performance at medium and lower injection pressures.

The ability to add the second fluid circuit only when necessary to achieve certain objectives, especially when injection pressure only achievable to date by unit injectors is the goal.

Overall, the injectors of the present invention have the Following Advantages:

1. Cold start—Engine can be started as a common rail system
2. The system can run as common rail system at idle and light loads, drastically reducing NVH
3. System can provide suitable limp home capability with complete hydraulic failure
4. System can provide suitable limp home capability with a high pressure fuel pump failure
5. System is capable of multiple injection events including boot injection
6. Uses much existing hardware/tooling
7. Nut stack is an application of an existing injector
8. Medium pressure fuel pump is an "off-the-shelf" unit
9. Capable of very high pressure and meets or exceeds technical requirements
10. Low capital investment—no pump development
11. Distinct product differentiation in the marketplace
12. Use of "fuel under" configuration results in much high needle valve closing rates and lower needle valve seat loading
13. Use of 3-way needle control valve improves efficiency and needle transient rate control The intensifier control valve could actually be made less expensively than prior valve by:

1. Relax tolerances
2. Increase seal overlap—decreases leakage
3. Increase open area—increases pressure efficiency
   a. Lower speed valve possible as this valve does not control minimum quantities or timing of any of the injection events
4. Possibility to eliminate one of the coils, as speed and cold start become less of an issue
5. Improve spool edge wear with increased overlaps
6. Slower intensifier control valve can improve NVH in the hydraulic system Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A fuel injector comprising:

a first port for coupling to a source of intensifier actuation fluid under pressure and a second port for coupling to an intensifier actuation fluid vent;

a third port for coupling to fuel under pressure;

an intensifier having an intensifier piston and an intensifier plunger;

a first control valve coupled to the first and second ports and to the intensifier piston for controlling an intensifier actuation fluid to and from the intensifier piston;

a needle in a needle chamber;

a needle closure piston coupled to fuel under pressure to encourage the needle to a closed position;

a needle control pin disposed to counteract the needle closure piston when fuel under pressure is provided to the needle control pin;

a second control valve coupled between the third port and the needle control pin to control fuel pressure provided to the needle control pin; and a check valve coupled to allow fuel flow from a source of fuel to the needle chamber, and to prevent fuel flow back to the source of fuel;

the intensifier actuation fluid not being fuel;

whereby the first control valve determines whether intensification occurs, and the second control valve controls fuel injection based on the pressure of fuel in the third port if intensification is not occurring, and controls fuel injection based on the intensified fuel pressure when intensification is occurring.

2. The fuel injector of claim 1 wherein the needle closure piston is coupled to fuel under the same pressure as fuel in the needle chamber, and the second control valve is coupled to pressure of fuel in the third port.

3. The fuel injector of claim 1 wherein the first control valve is a three way solenoid operated spool valve.

4. The fuel injector of claim 1 wherein the second control valve is a solenoid operated double acting poppet valve.

5. The fuel injector of claim 4 wherein the double acting poppet valve includes a self aligning floating seat.

6. The fuel injector of claim 1 wherein the source of fuel is the third port, and the check valve also allows fuel flow from the third port to the intensifier plunger, and prevents fuel flow back to the third port from the intensifier plunger.

7. The fuel injector of claim 1 wherein the source of fuel is at a lower pressure than the fuel under pressure in the third port, and further comprising a double acting check valve coupled to the third port, the intensifier plunger, and to the needle chamber, the double acting check valve being responsive to the difference in pressure between the intensifier plunger and the third port to allow fuel flow from the third port to the needle chamber when the intensifier plunger pressure is no greater than the pressure in the third port, and to block fuel flow from the intensifier plunger to the third port and allow fuel flow from the intensifier plunger to the needle chamber when the intensifier plunger pressure is greater than the pressure in the third port.

8. A fuel injector comprising:

a first port for coupling to a source of intensifier actuation fluid under pressure and a second port for coupling to an intensifier actuation fluid vent;

a third port for coupling to fuel under pressure;

an intensifier having an intensifier piston and an intensifier plunger;

a first control valve coupled to the first and second ports and to the intensifier piston for controlling an intensifier actuation fluid to and from the intensifier piston;

a needle in a needle chamber;

a second control valve coupled between the third port and a direct needle control to control needle opening and closing responsive to fuel pressure in the third port; and a check valve coupled to allow fuel flow from a source of fuel to the needle chamber, and to prevent fuel flow back to the source of fuel;

the intensifier actuation fluid not being fuel;

wherein the second control valve is a solenoid operated double acting poppet valve;

whereby the first control valve determines whether intensification occurs, and the second control valve controls fuel injection based on the pressure of fuel in the third port if intensification is not occurring, and controls fuel injection based on the intensified fuel pressure when intensification is occurring.

9. The fuel injector of claim 8 wherein the double acting poppet valve includes a self aligning floating seat.

10. A fuel injector comprising:

a first port for coupling to a source of intensifier actuation fluid under pressure and a second port for coupling to an intensifier actuation fluid vent;

a third port for coupling to fuel under pressure;

an intensifier having an intensifier piston and an intensifier plunger;

a first control valve coupled to the first and second ports and to the intensifier piston for controlling an intensifier actuation fluid to and from the intensifier piston;

a needle in a needle chamber;

a second control valve coupled between the third port and a direct needle control to control needle opening and closing responsive to fuel pressure in the third port; and a check valve coupled to allow fuel flow from a source of fuel to the needle chamber, and to prevent fuel flow back to the source of fuel;

the intensifier actuation fluid not being fuel;

whereby the first control valve determines whether intensification occurs, and the second control valve controls fuel injection based on the pressure of fuel in the third port if intensification is not occurring, and controls fuel injection based on the intensified fuel pressure when intensification is occurring wherein the source of fuel is at a lower pressure than the fuel under pressure in the third port, and further comprising a double acting check valve coupled to the third port, the intensifier plunger, and to the needle chamber, the double acting check valve being responsive to the difference in pressure between the intensifier plunger and the third port to allow fuel flow from the third port to the needle chamber when the intensifier plunger pressure is no greater than the pressure in the third port, and to block fuel flow from the intensifier plunger to the third port and allow fuel flow from the intensifier plunger to the needle chamber when the intensifier plunger pressure is greater than the pressure in the third port.

* * * * *